United States Patent [19]

Hwang

[11] Patent Number: 4,695,815

[45] Date of Patent: Sep. 22, 1987

[54] AUTOMOBILE FUSE WITH DAMAGE INDICATOR

[76] Inventor: Chern Hwang, 8, Lane 158, Nan Gang Rd., Nan Gang District, Taipei, Taiwan

[21] Appl. No.: 731,385

[22] Filed: May 7, 1985

[51] Int. Cl.[4] ..... H01H 85/32

[52] U.S. Cl. ..... 337/266; 337/198; 337/242; 439/488; 439/621; 439/910

[58] Field of Search ..... 337/242, 241, 266, 198; 339/147 P; 361/347

[56] References Cited

U.S. PATENT DOCUMENTS 3,132,224 5/1964 Bulgin ..... 337/242

4,499,447 2/1985 Greenberg ..... 337/266

*Primary Examiner*—Harold Broome

[57] ABSTRACT

An automobile fuse with damage indicator, in which two conductors of a small indicator bulb are connected in parallel with two conductors of a fusible link so that the bulb does not light as long as the fuse is in good condition; but will light immediately by current passing through the load after the fusible link is broken by an overload. The lighting of an indicator at the place where the fuse is installed directly indicates a burnt fuse, particularly at night or in a dark place and trouble shooting and replacement of fuse can be conducted quickly.

5 Claims, 3 Drawing Figures

AUTOMOBILE FUSE WITH DAMAGE INDICATOR

BACKGROUND OF THE INVENTION

The car symbolizes modern civiliztion its combination of mechanisms and components are achievements based on the wisdom of human beings. Electrical systems in a car, such as head lights, indicator lights, brake lights, and so on are installed with fuses to prevent damage to each respective system due to current overloads. Inclusion of fuses is a wise safety feature, however existing fuse design is imperfect since it is quite difficult to find a burnt fuse from among the at least seven or eight fuses within a car. Testing and checking each fuse one by one is required before a burnt fuse can be found making detection and replacement of a burnt fuse is a troublesome task, particularly at night or in a dark environment. It is quite difficult to ascertain which fuse has been damaged as well as being quite difficult to find it within a car. Furthermore, a good fuse may be mistakently regarded as damaged and discarded unnecessarily which is a meaningless waste of money, in addition to not solving the problem. Therefore, the inventor herein has created an automobile fuse with a damage indicator as disclosed herein to clearly indicate which fuse has been furnt at any time during the day or at night, or at any time in a dark environment at once by illumination of a small bulb, rendering its replacement easier to make the electric system workable again at once.

SUMMARY OF THE INVENTION

This invention provides an automobile fuse, particularly one with damage indicator. It is a fuse with a small built-in indicator bulb connected to the fuse in parallel so that the bulb will not light while the fuse is in good condition, but will light up immediately if the fuse becomes burnt because the full current will pass through the bulb instead of through the fuse material. The lighting up of such an indicator bulb in a plurality of fuses within a car will indicate exactly which fuses have been burnt at any time, particularly at night or in a dark environment permitting prompt replacement of the fuse and trouble-shooting.

DETAILED DESCRIPTION

Figure 1:
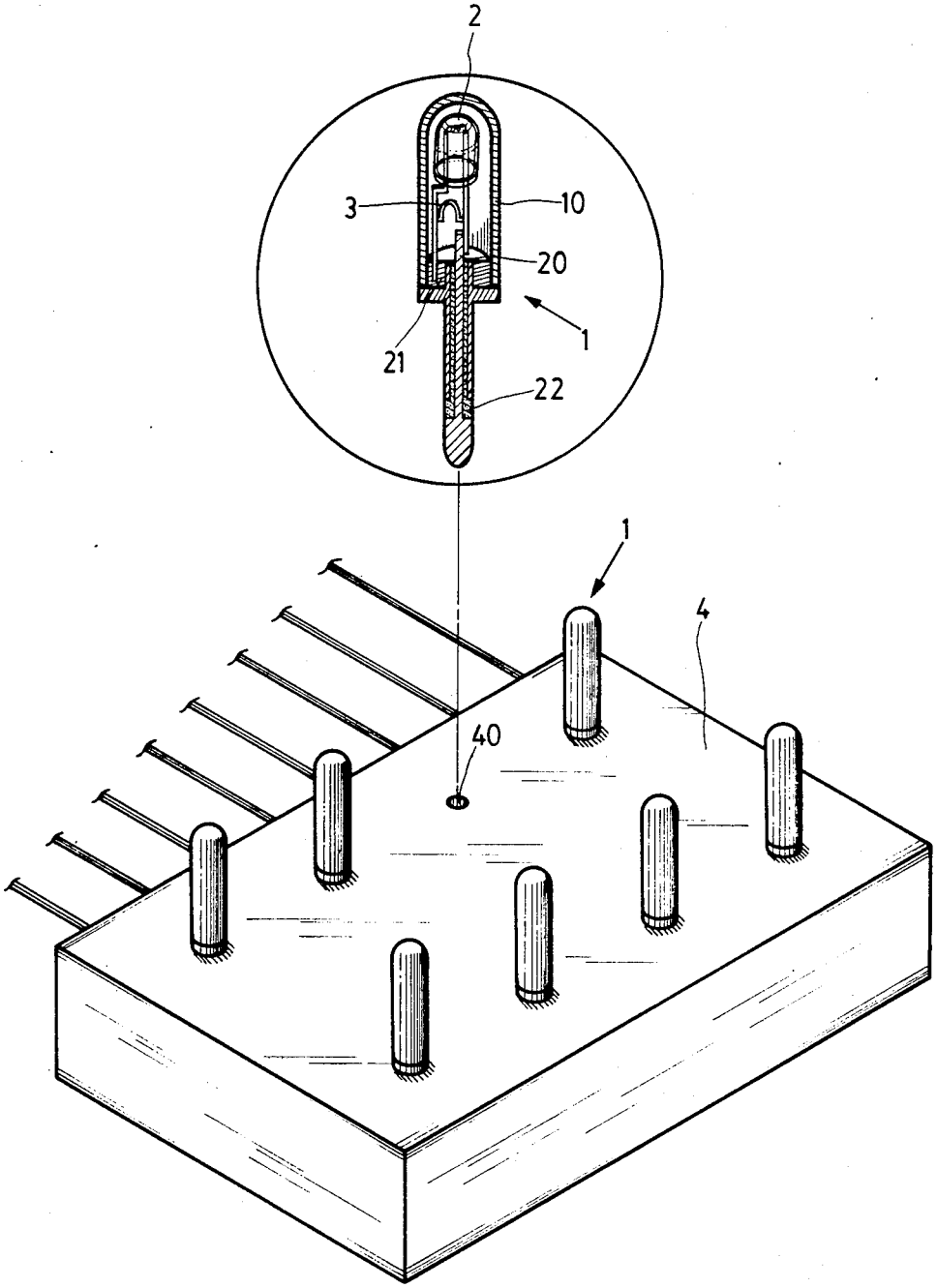
FIG. 1 is a perspective of the present invention.
Figure 2:
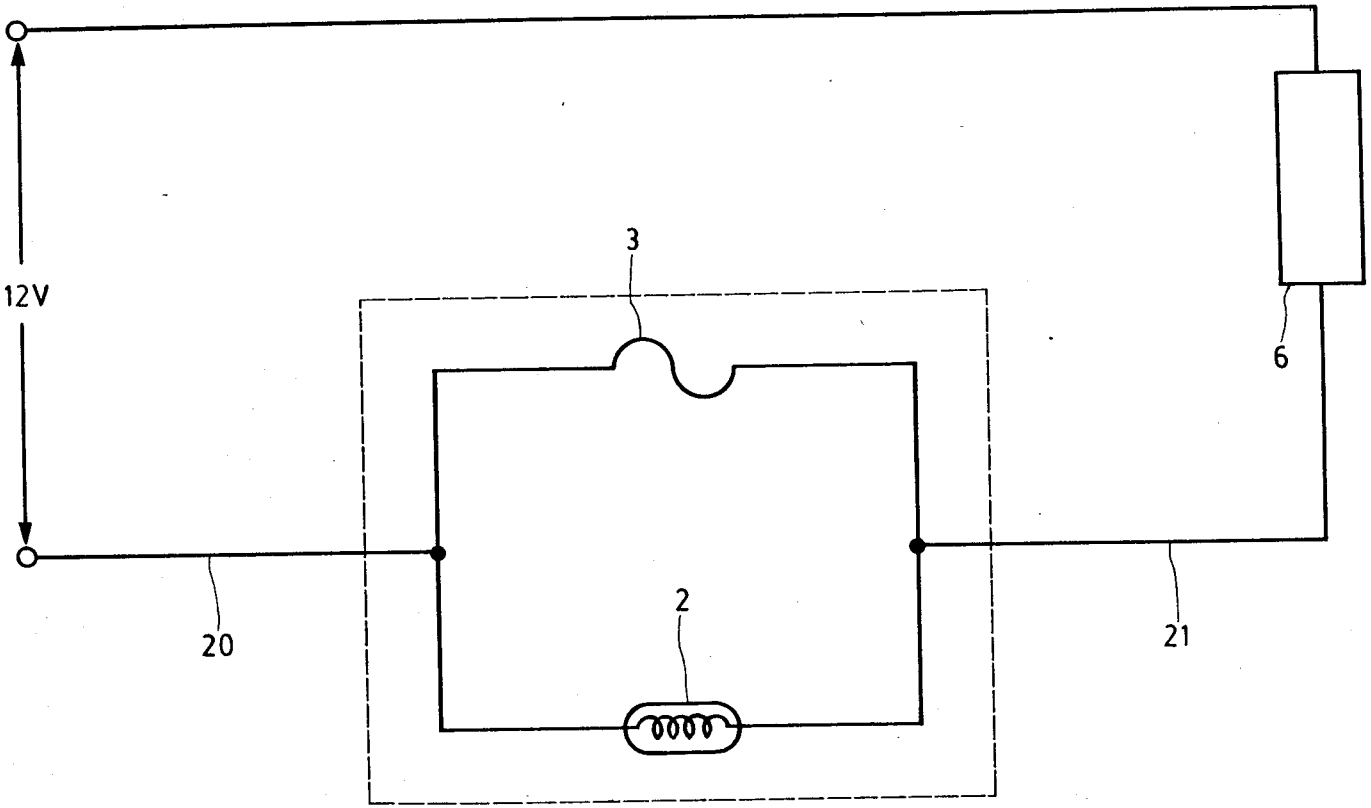
FIG. 2 is a circuit diagram of the present invention.

Referring to FIG. 1, there is shown a perspective view of the present invention, in which the fuse case 1 comprises a pin-like lower end, comprising a positive conductor 20, and a negative conductor 21, and a cylindrical transparent shell 10 within which is a small indicator bulb 2 having its two conductors connected with the positive conductor 20 and the negative conductor 21 respectively. An insulator 22 is placed between the conductors 20 and 21, and there is a fusible link 3 between the two conductors of the bulb 2; the bulb 2 and the fusible link 3 are in parallel connection. In a car, all fuse cases 1 for the various electrical systems, such as lighting, and so on, are installed on a rectangular pinboard 4 having a plurality of pin holes 40; each pin hole 40 accepts one fuse case 1. For wiring, refer to FIG. 2, which illustrates a basic circuit diagram of the present invention. When a current I is applied between the conductor 20 and the conductor 21, the current passing through the fusible link 3 is $I_f$, and the current passing through the bulb 2 is $I_L$. Since the fusible link 3 and the bulb 2 are connected in parallel, the relationship between these currents is: $I=I_f+I_L$. Generally, the current in the electrical system of a car is always greater then 1 Ampere. The indicator bulb used in the present invention is of 12 V×20 mA, with a resistance of 600 Ohms. If the minimum current passing the load 6 of the various electrical systems in a car is one Ampere, the inner resistance over the load 6 is 12 Ohms; under normal conditions most of the current passes through the fusible link 3 if the fuse is in good condition, and the indicator bulb 2 can't light due to insufficient electrical potential. If the current $I_f$ becomes too large, the fusible link 3 will be burnt out, and the potential between the conductor 20 and the conductor 21 will be applied to the bulb 2; causing it to glow. The present invention is designed such that the indicator bulb 2 will be lit only if the fusible link 3 is burnt out permitting any burnt fuse 1 to be removed from the pinboard 4 and replaced at once.

Figure 3:
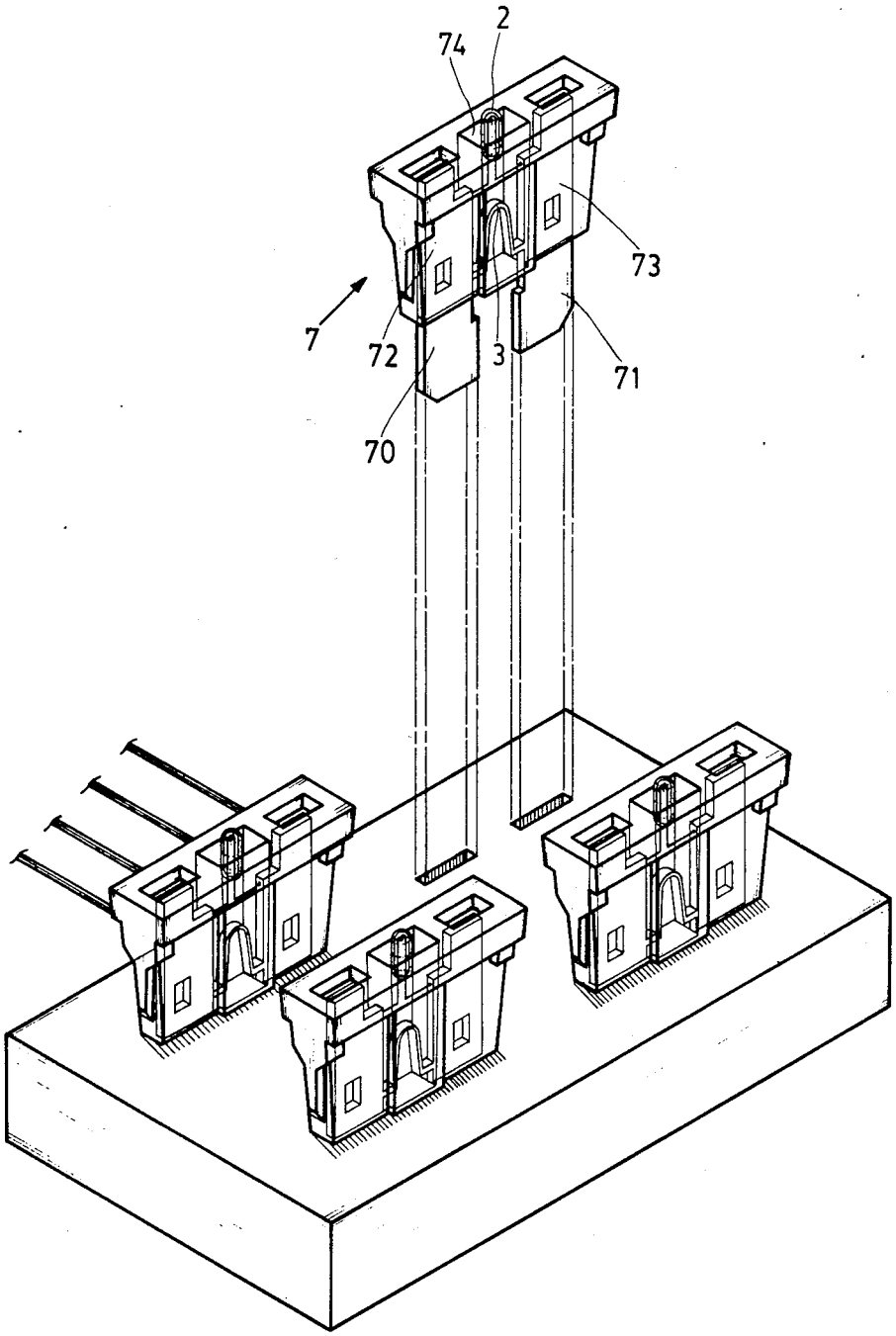
FIG. 3 is a perspective view of another embodiment of the present invention.

FIG. 3, illustrates a perspective view of another embodiment of the present invention, which includes a thin rectangular plastic fuse cassette 7 with a first elongate copper plate 70 and a second elongate copper plate 71, one at each side, and two plate holders 72 and 73. There is a bulb holder 74 for holding a small indicator bulb 2 at the top center of the fuse casette 7. The fuse cassette 7 is to be inserted into a pinboard 4. The indicator bulb 2 will light immediately upon the fusible link 3 therein being burnt out so as to warn the driver to replace the fuse.

In conclusion, the present invention provides fuses for automobiles which can indicate a burnt fuse by the lighting of an indicator. The present invention fully eliminates the disadvantage of the existing fuse design which makes checking for burnt fuse at night or in a dark place very difficult. Furthermore, the present invention applies a pinboard to hold all the required fuses together to facilitate fuse checking and replacement. Therefore, the present invention is a device which solves the problem of checking and replacing fuses, and it is in fact a perfect and revolutionary fuse design.

I claim:

1. An automobile fuse with damage indicator means comprising a cylindrical, transparent shell having an open end and a closed end;

a pin comprising a pair of conductors separated by an insulator, the pin having an upper end and a lower end, the upper end being inserted into the open end of the shell to form a sealed portion; and disposed within the sealed shell portion, a fusible link and an indicator bulb in electrical connection with the pair of conductors.

2. The automobile fuse according to claim 1 wherein the pair of conductors are concentrically arranged and separated by the insulator to form a single electrical connection pin insertable into an electrical pin board.

3. The automobile fuse according to claim 2 wherein the conductors extend into the lower portion of the transparent shell and the indicator bulb has two electrically connected conductors, one to each of the pair of conductors in the pin.

4. The automobile fuse according to claim 3 wherein the fusible link is electrically connected in parallel circuitry with the indicator bulb and between the conductors of the bulb.

5. The automobile fuse according to claim 2 wherein the conductor forming the outer shell of the pin is radially expanded to form a base for sealing the transparent shell and the lower end of the conductor forming the inner shell is enlarged to form a pin having the same diameter along the longitudinal axis thereof.

* * * * *